US005133371A

United States Patent [19]

Sivess

[11] Patent Number: 5,133,371

[45] Date of Patent: Jul. 28, 1992

[54] ABSORBENT BEAUTY COIL

[75] Inventor: George P. Sivess, Hendersonville, N.C.

[73] Assignee: Kimberly-Clark Corporation, Neenah, Wis.

[21] Appl. No.: 136,233

[22] Filed: Dec. 21, 1987

[51] Int. Cl.[5] ..... A45D 7/02

[52] U.S. Cl. ..... 132/212; 604/378; 604/358; 428/913

[58] Field of Search ..... 132/212; 604/378, 370, 604/358, 363; 428/74, 68, 36.3, 35.6, 913, 373

[56] References Cited

U.S. PATENT DOCUMENTS

| | | | |
|---|---|---|---|
| 1,484,042 | 2/1924 | Smilie | 2/12 |
| 1,697,919 | 1/1929 | Knepper | 2/171 |
| 2,023,279 | 12/1935 | McNutt | 132/274 |
| 2,265,530 | 12/1941 | Kleinman | 2/181 |
| 2,544,798 | 3/1951 | Lippmann | 2/181 |
| 2,783,474 | 3/1957 | Campagna et al. | 2/171 |
| 3,050,071 | 8/1962 | Hall | 132/212 |
| 3,529,308 | 9/1970 | McBride et al. | 2/174 |
| 3,683,912 | 8/1972 | Olson et al. | 604/370 |
| 4,300,561 | 11/1981 | Kaczmarzyk et al. | 604/370 |
| 4,305,391 | 12/1981 | Jackson | 604/370 |
| 4,481,680 | 11/1984 | Mason et al. | 2/174 |
| 4,502,156 | 3/1985 | Wishman | 2/181 |
| 4,723,954 | 2/1988 | Pieniak | 604/378 |

*Primary Examiner*—Gene Mancene
*Assistant Examiner*—Adriene B. Lepiane
*Attorney, Agent, or Firm*—William D. Herrick

[57] ABSTRACT

There is disclosed an absorbent beauty coil comprising an absorbent core and a non-retentive cover, which beauty coil exhibits increased absorbency of permanent waving solution and other fluids before dripping. Wicking action at the interface of the cover and the core draws fluid to unsaturated areas, thereby preventing dripping at saturated areas of the coil.

5 Claims, 3 Drawing Sheets

ABSORBENT BEAUTY COIL

BACKGROUND OF THE INVENTION

The invention relates generally to absorbent beauty coils, and more particularly concerns a covered beauty coil, the characteristics of which result in improved absorption of liquids, increased strength, and improved protection of a user's skin.

Absorbent beauty coils are used by persons obtaining hair or scalp treatments, particularly permanent waving treatments, to provide a liquid absorbent barrier between the head area being treated and the face area which may be irritated by liquids used in such treatments. Such absorbent beauty coils are wrapped around the user's head, following the hairline, and are intended to absorb any excess liquid that exudes from the user's hair. Absorbent beauty coils must be highly absorptive, soft to the user's skin, strong enough not to tear when wet or when wrapped around a user's head, and relatively lint free such that absorptive fibers do not cling to the user's wet hair. In addition, the surface of the beauty coil should remain relatively dry in order to minimize irritation to the skin.

A number of manufacturers make unwrapped beauty coils, including Kimberly-Clark Corporation, the assignee of the present invention. Kimberly-Clark Corporation manufactures and sells a beauty coil under the trademark Cellucotton which beauty coil may also incorporate a reinforcing strip. Other beauty coils include the Empress and Dutchess line of reinforced and unreinforced cotton beauty coils manufactured by the National Patent Development Corporation, Acme/Chaston Division, New York, N.Y. BNT Company, Inc. of Lakeland, Fla. manufactures the reinforced Omnia Cosmetic Beauty Coil. Coillir Manufacturing, Inc. of North Royalton, Ohio manufactures the nonreinforced Coillir Beauty Coil. Carolina Absorbent Company, a division of Barnhardt Manufacturing Company of Charlotte, N.C., manufactures reinforced and nonreinforced Princess and Your Highness Beauty Coils. Megas Manufacturing, Inc. of Cleveland, Ohio manufactures the Sof-Coil Reinforced Beauty Coil. Little Rapids Corporation of Green Bay, Wis. manufactures the reinforced Soft-Sorb Beauty Coil. Witten Manufacturing Company, Inc. of Gastonia, N.C. manufactures reinforced and nonreinforced BeautiSoft Absorbent Coil. These absorbent beauty coil products are simply carded slivers of absorbent material without any outside covering. Such prior art coils become saturated in use resulting in drippage and skin burning or irritation.

Other prior art products which relate to hair and scalp treatments include certain barrier or trough devices and forehead shields. The patents describing such products do not disclose or teach the wicking action utilized by the beauty coil of the present invention.

McBride U.S. Pat. No. 3,529,308 discloses a hairholding device composed of a metal or plastic partially oval-shaped cross-sectioned skirt portion and an edge portion along the underside of the skirt portion, to which a strip of felt or sponge may be secured for frictional and sealing contact. Mason et al. U.S. Pat. No. 4,481,680 discloses a protective visor for hair and scalp treatments. The visor is a planar strip of flexible material having a substantially crescent shape and a raised rib along the inner edge of the crescent-shaped strip. This visor creates a liquid impermeable barrier between the user's scalp and the user's face and neck. McNutt U.S. Pat. No. 2,023,279 discloses a forehead shield for beauty work comprising plies of creped gauze tissue paper having longitudinal parallel short impressors for binding the plies together. The shield is designed to protect the face from the impressions formed by a hairnet placed on the head.

Other prior art products which are designed to absorb perspiration rather than beauty treatment fluids may incorporate the sausage-or envelope-like design embodied in the beauty coil of the present invention. Because perspiration is evenly distributed around the user's head, such products do not require longitudinal wicking to utilize the absorbent capacity completely. Consequently, those prior art products do not incorporate or disclose the wicking action of the coil of the present invention and are designed to absorb comparatively less liquid than the coil of the present invention. Smilie U.S. Pat. No. 1,484,042 discloses an athletic eyeguard comprising a trough containing absorbent cotton enclosed in an envelope of cotton gauze held against the forehead by a visor or other headgear. Knepper U.S. Pat. No. 1,697,919 discloses a perspiration pad composed of an absorbent filler enclosed in a covering of gauze which is wrapped around the filler. Kleinman U.S. Pat. No. 2,265,530 discloses a sweatband composed of a number of absorbent "wicks" or cores enclosed in a leather headband, one side of which is waterproof fabric, the other side leather. Lippmann U.S. Pat. No. 2,544,798 discloses a sweatband having an inner cushion made of interlaced or matted staple fibers. The fibers are thermoplastic material and the surface of the cushion is a densified skin. The cushion is enclosed in an outer textile fabric envelope. The inner fibrous cushion is skinned in order to prevent any staple fibers from slipping out through the fabric envelope and to assist in preventing perspiration from passing through the sweatband from the head side to the hat fabric. Campagna et al. U.S. Pat. No. 2,783,474 discloses a fibrous and absorbent perspiration pad made of a carded batt of cellulose acetate and bleached cotton fibers, enclosed in a woven fabric such as cheesecloth.

One prior art fabric discloses the moisture-transferring or "wicking" ability of nonwoven polypropylene fabric which has the fibers on one side fused and the fibers on the opposite side unfused. When wetted, such fabric exhibits a wet feeling on the fused side and a substantially dry feeling on the unfused side. Wishman U.S. Pat. No. 4,502,156 discloses that this characteristic of nonwoven polypropylene fabric is "apparently attributable to the capacity of polypropylene fibers to cause the wicking or migrating of moisture therethrough." Col. 5, lines 4–8. The beauty coil of the present invention does not incorporate such fusing.

SUMMARY OF THE INVENTION

Therefore, it is an object of the present invention to provide an absorbent beauty coil which has an outside covering that transfers liquid into the internal component of the coil where it is absorbed away from the customer's skin, thereby preventing possible skin burns and/or skin irritation.

It is likewise an object of the present invention to provide an absorbent beauty coil which has an outer layer or covering which, at the interface of the covering and the internal absorbent component, facilitates longitudinal wicking of fluid from saturated portions of the internal absorbent component of the coil to unsaturated portions thereof.

It is another object of the present invention to provide an absorbent beauty coil which offers a dry, soft surface to provide maximum user protection and comfort while strengthening the coil and preventing the internal absorbent component of the coil from linting onto the user's face or hair.

The foregoing objectives are achieved by an absorbent beauty coil comprising a flexible core composed of an absorbent fiber filler, and a non-retentive, fluid permeable, flexible fiber fabric cover. The beauty coil is formed by enveloping the absorbent flexible body portion in a rectangular strip of the fiber fabric such that the longitudinal edges of the cover fabric meet and are joined to form a sausage-like piece. The resulting beauty coil is wrapped around the head of a user, following the hairline, and secured at its ends by any appropriate means, including hair clips or a self-knot. The absorbent beauty coil has a high degree of absorption and as a result of its wicking characteristics prevents point saturation and localized drippage. In addition, the beauty coil of the present invention is strong, is lint free, and has a soft, dry surface for the user'skin.

Particularly, the flexible core of the present invention comprises an absorbent fiber filler which may be composed of any type of absorbent fiber, including super absorbents, wadding, nylon fibers, polyester fibers, cotton, rayon, or blends thereof. Indeed, an advantage of the present invention is the ability to use low cost absorbent fibrous fillers with relatively low cohesiveness and strength, inasmuch as the covering supplies the absorbent beauty coil with these attributes. The flexible fiber fabric cover comprises a non-retentive, fluid permeable fiber fabric which is dry, soft, and low linting. The cover prevents lint from the absorbent fiber core from escaping and clinging to the user's wet hair or skin. The nonretentive cover also keeps the user's facial skin dry to minimize chemical burning. The interface between the cover and the core provides a longitudinal wicking path so that fluid can move from saturated portions to unsaturated portions of the absorbent internal component and thereby prevent drippage down the user's face.

Other objects and advantages of the invention will become apparent upon reading the following detailed description and upon reference to the drawings.

DETAILED DESCRIPTION OF THE INVENTION

While the invention will be described in connection with the preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
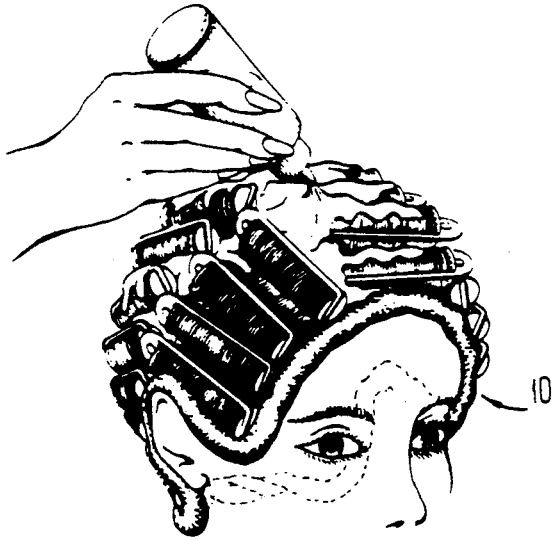
FIG. 1 is a prospective view showing the application of the absorbent beauty coil of the present invention to a user's hairline during treatment with permanent waving or other solution.

Turning to FIG. 1, there is shown an absorbent beauty coil 10 embodying the present invention. The absorbent beauty coil 10 is used to protect the facial skin of a user from the liquids employed in permanent waving or other hair or scalp treatments. The absorbent beauty coil 10 may be supplied to a user or beauty professional in the form of a long sausage-like piece which is severed to a length approximating the circumference of the user's head at the hairline, plus some additional length to allow for securing the sausage-like piece at its ends. The absorbent beauty coil 10 is placed around the user's hairline and secured by appropriate means, such as a hair clip.

Figure 2:
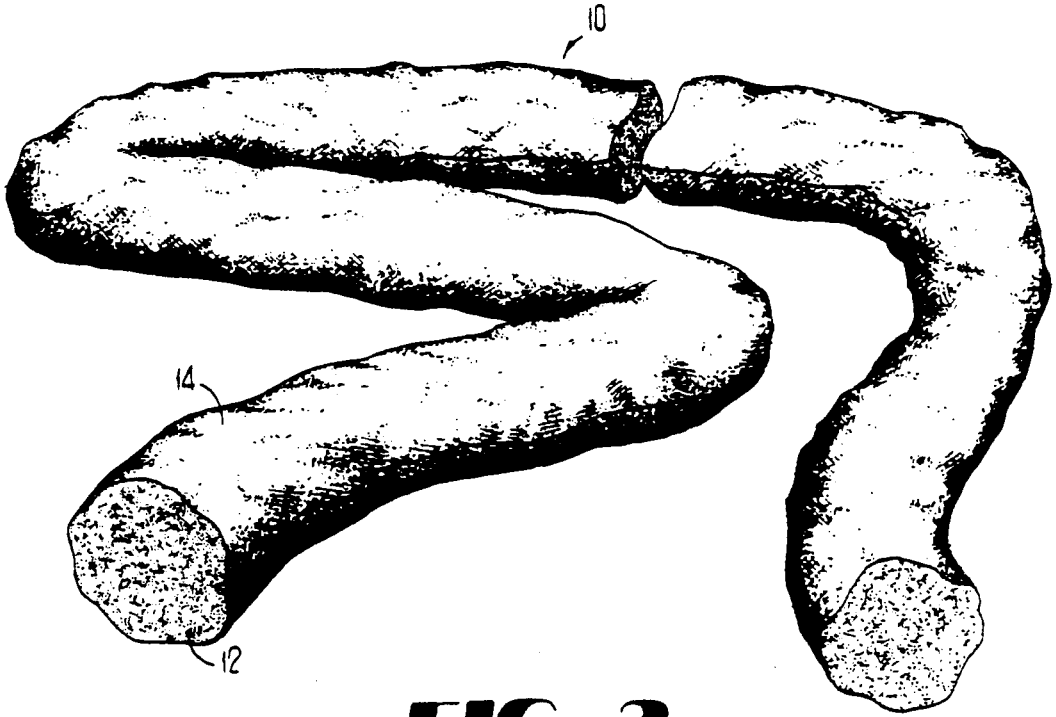
FIG. 2 is a prospective view showing the absorbent beauty coil of the present invention with cross-sections of the coil shown at each end of the severed coil.
Figure 3A:
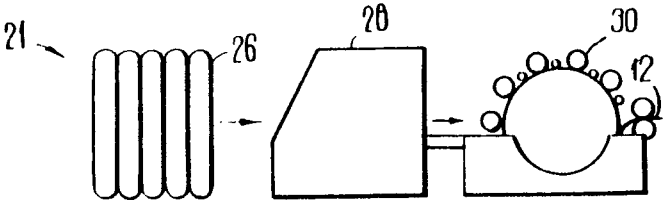
FIGS. 3A, 3B, 3C, and 3D are schematic representations of the machinery and process for manufacturing the absorbent beauty coil of the present invention.
Figure 3B:
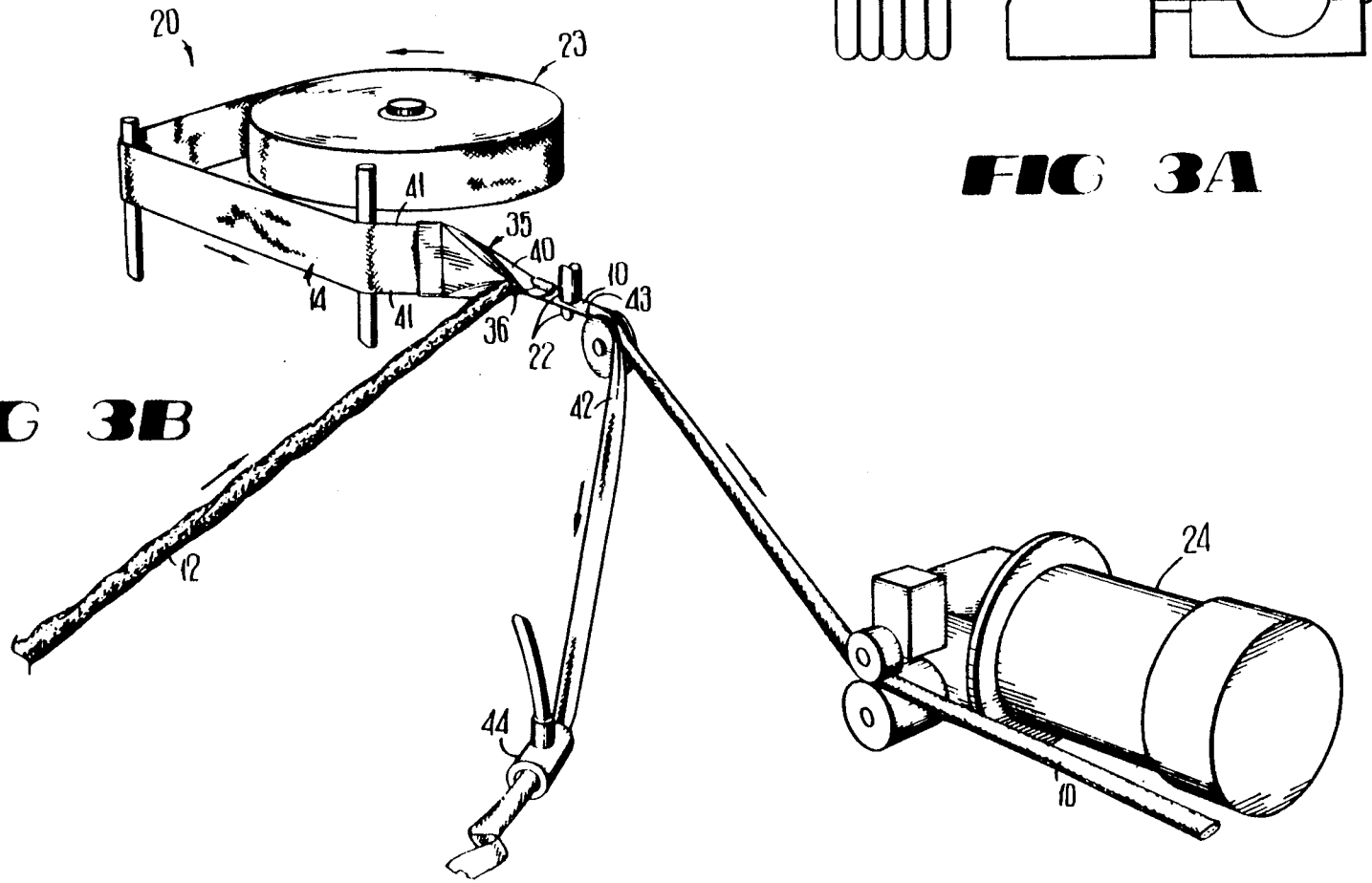

The absorbent beauty coil 10 consists of a flexible absorbent core 12 and a cover 14 (FIG. 2). Particularly, the internal core 12 of the coil 10 consists of a single continuous untwisted strand or bundle of flat fibers called a "silver" which is produced by a conventional carding process. Carding separates fibers from each other, lays them parallel, forms them into a thin web, and then condenses them into the sliver.

The outer fiber fabric covering 14 comprises randomly oriented discrete thermal plastic fibers made by a melt-blown, spun-bonded, or spun-lace process. Nonwoven melt-blown material is prepared in accordance with the disclosures of NRL Report 4364, "Manufacture of Super-Fine Organic Fibers," by V. A. Wendt, E. L. Boon, and C. D. Fluharty; NRL Report 5265, "An Improved Device for the Formation of Super-Fine Thermoplastic Fibers," by K. D. Lawrence, R. T. Lukas, and J. A. Young; and U.S. Pat. No. 3,849,241, issued Nov. 19, 1974, to Buntin, et al. Nonwoven spunbond materials are prepared in accordance with the disclosures of the following patents: Dorschner et al. U.S. Pat. No. 3,692,618; Kinney U.S. Pat. Nos. 3,338,992 and 3,341,394; Levy U.S. Pat. No. 3,276,944; Peterson U.S. Pat. No. 3,502,538; Hartmann U.S. Pat. Nos. 3,502,763 and 3,909,009; Dobo et al. U.S. Pat. No. 3,542,615; and Harmon Canadian Patent No. 803,714. Nonwoven spun-lace or tangled-weave materials are prepared in accordance with the disclosure of the following patents: Evans U.S. Pat. No. 3,485,706; Ballou et al. U.S. Pat. No. 3,485,708; and Bunting, Jr. et al. U.S. Pat. No. 3,493,462.

Turning to FIGS. 3A, 3B, 3C, and 3D, there is shown schematically a process and machinery 20 for manufacturing the absorbent beauty coil in accordance with the present invention. The machinery 20 includes carding section 21 (FIG. 3A), a cover unwind station 23, a combiner/folder 35, a slitter/sealer 22, tractor 24, trim remove air jet 44. The carding section 21 is conventional. Particularly, a bale 26 of fibers is opened and fluffed and fed by an opener/feeder 28 into a fiber card 30. The card 30 untangles the fibers and aligns them into a thin, even web. The web is then gathered or folded in upon itself to form a round strip of fibers called a sliver which forms the core 12 of the beauty coil. As the fibers are being formed into the sliver 12, other materials may be introduced in metered quantities. These materials may include reinforcing strips (wadding), superabsorbent strips, nylon or polyester filaments, and the like.

The sliver 12 is then fed into a guide tube 36 of the combiner/folder 35. The cover 14 is folded around the sliver 12 by means of an internal folding board 40. The wrapped sliver 11 is then fed through the sonic slitter 22, which seals the two longitudinal edges 41 of the cover 14 together along a seam line 43 and slices off excess material 42. The excess covering material 42 is drawn off by means of a trim removal air jet 44. The resulting beauty coil 10 is pulled by tractor 24 from the slitter and fed to a coiler head (not shown) where it is coiled into a plastic bag prior to packing in cases for shipment. Other adhesive systems (hot melt, for example) could be used to seal the cover, but the sonic bonder is generally preferred.

Figures 3C, 3D, 4:
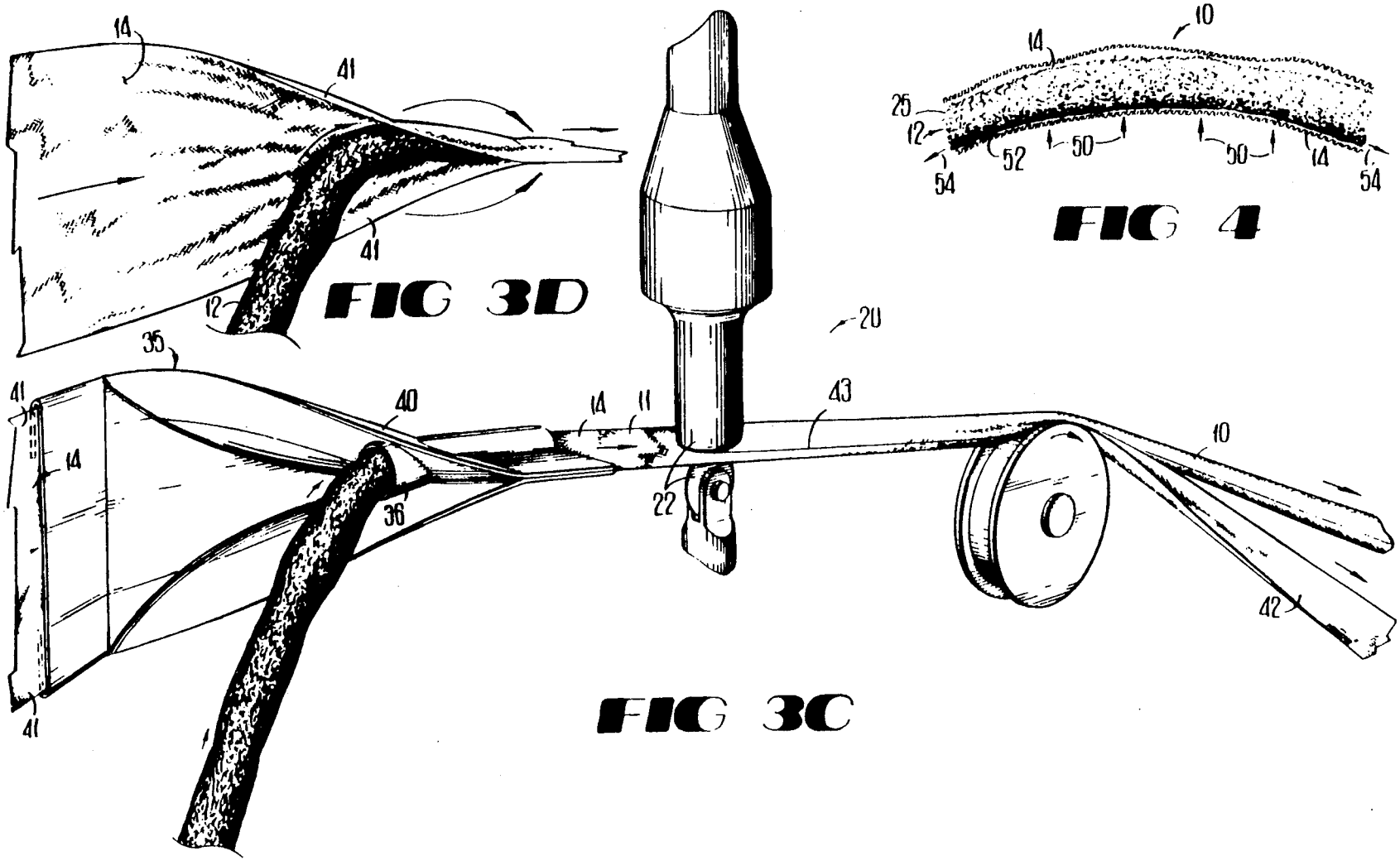
FIG. 4 is a longitudinal cross-sectional view of the absorbent beauty coil of the present invention showing the flow of fluid as it passes through the outer cover into the absorbent core and is wicked along the interface of the cover and the core.

Turning to FIG. 4, there is shown a cross-sectional view of the beauty coil 10 showing the transfer of liquid through the covering material 14 into the absorbent fibers 25 of the core 12 (arrows 50) and the longitudinal wicking of liquid along the interface 52 of the cover 14 and the core 12 (arrows 54).

In manufacturing the absorbent beauty coil 10 of the present invention, the absorbent fibers 25 for the core 12 may be of any sort which are capable of passing through the carding wire. The core 12 weighs 5.0 grams per 36 inches of length and is preferably a blend of 1.5 denier and 3.0 denier staple length rayon fibers having an average length of 1.5625 inch. Other suitable fibers 25 for the core 12 include 3.0 denier, 1.4 inch to 1.6 inch staple length, regular crimp bleached rayon fibers with standard rayon finish. Still other suitable fibers 25 for the core 12 include 3.0 denier, 1.5625 inch staple length, super crimp bleached rayon fiber with non-ionic wettability finish.

The cover 14 may be made from any fiber fabric otherwise suitable for the purposes of the invention and which may be bonded or sealed together around the internal absorbent core of the coil. The fibers suitable for the cover may include polypropylene, polyethylene, copolymers of ethylene and propylene, and blends of polypropylene and polyethylene. A 0.375 ounce per square yard (oz/yd$^2$) spun-bonded wrap of spun-bonded polypropylene fabric supplied in three-inch wide rolls, however, is preferred.

The resultant absorbent beauty coil 10 possesses several important characteristics. First, the beauty coil is water absorbent. In that regard, the absorbent beauty coil should have a water absorbing capacity of typically about 1850%, or at least about 75.0 grams, tyically about 90.0 grams, per 36 inches of coil. The absorbent beauty coil of the present invention should have an absorption rate for water of not greater than 15.0 seconds, typically about 3.0 seconds. Most importantly, however, the beauty coil 10 is able to wick fluid, particularly permanent waving solution, from saturated to unsaturated portions of the coil 10 such that the absorbent capacity of the coil 10 is utilized to the maximum extent possible. To this end, the coil 10 should absorb in a wick/drip test at least 17 milliliters, typically about 21 milliliters, of permanent waving solution before dripping. Example 1 below illustrates the dramatic increase in the amount of fluid absorbed during the wick/drip test by the absorbent coil 10 before dripping as compared to the fluid absorbed by the core alone. Alone the core 12, for example, absorbs 6.3 milliliters of perm solution before dripping during the wick/drip test. When the same core is wrapped with the cover 14 to form the coil 10 of the present invention, the resulting core 10 absorbs 21.5 milliliters before dripping. Other prior art coils absorb up to 16.1 milliliters of fluid before dripping. An average amount absorbed by prior art coils before drippig is 9.5 milliliters. FIG. 4 shows the flow of fluid as it is transferred into the internal absorbent core 12 (arrows 50) and wicked to unsaturated areas thereof (arrows 54). As a consequence, the user can be protected from the effects of saturation at points along the coil and the resulting drippage and skin irritation.

The absorbent beauty coil 10 is lightweight for comfort, having a basis weight of between about 5.0 and 6.0 grams per 36 inches of length, most preferably about 5.5 grams per 36 inches. The absorbent beauty coil 10 has sufficient tensile strength to resist tearing during handling and when wet and hence should possess tensile strength in the range of between about 300 and 4000 grams when dry, typically 2000 grams, and typically 2500 grams when wet. The absorbent beauty coil 10 is also clean looking and bright white colored. Consequently, the absorbent beauty coil 10 should have a lightness reading of between about 80 and 94 Rd, most preferably about 87 Rd. The absorbent beauty coil 10 should have a color "a" reading of −0.25 and a color "b" reading of +6.0. In accordance with the present invention, the cover 14 of absorbent beauty coil 10 is lint free and confines lint from the core. The cover 14 retains very little liquid itself so that the coil 10 feels dry even when the core is saturated.

The characteristics outlined above are determined in accordance with standardized test procedures, except for wicking, water rate, and capacity. Existing test procedures for absorption capacity do not demonstrate the "no drip" advantages of the beauty coil of the present invention. Consequently, a Wick/Drip Test was designed to measure the amount of permanent waving solution absorbed by a sample of beauty coil of the present invention before dripping and to simulate actual application conditions. Wicking is tested by metering a test solution from a buret at a rate of about 4 ml/60 seconds onto a 30 degree inclined sample stand. The test solution is thioglycolic acid (perm solution) with green food coloring added to enhance perceptibility. The buret tip should be two inches from the sample stand and three inches above the test sample. The solution is metered until the first drop of solution is released from the test sample. The amount of solution metered at this point is recorded. The inclined sample stand simulates the slope of a user's head. The test coil sample is clamped on the sample stand and thus positioned, simulates the coil stretched across a user's forehead as secured by perm rods on both sides on the user's head. The solution's flow down the stand to the coil simulates the flow of the liquid as it streams down the scalp and contacts the coil.

The rate of water absorbing is determined using 36 inches of coil, placed on the surface of a water bath, maintained at room temperature, and timed for complete wetting (sinking). Capacity is determined by removing the saturated sample from the water bath with a ¼" wire basket, draining for 30 seconds in the basket (screen should not be tipped while draining sample), and weighing. Tensile strength is determined according to Federal Test Method Standard No. 191 A (Method 5102) or ASTM Standards D 1117-6, D1682. Lightness and color "b" readings are determined according to RTM-6150, using the CW Tile and a Hunter Meter. Color "a" readings are determined in accordance with RTM 6150.

The present invention is illustrated by the following absorbent beauty coils.

EXAMPLE 1

An absorbent beauty coil which prevents drippage down a user's face, is lint-free, strong, and of superior feel and appearance:

Absorbent core—nonreinforced

Wonalancet low basis weight non-reinforced fiber: Type 460 fiber, 100% Viscose (Wonalancet Company, Atlanta, Ga.)

Covering

Spun-bond 0.375 oz/yd$^2$ wrap:

Polymer: 98% Himont PC-973 polypropylene by weight (Himont USA, Inc., Wilmington, Del.)

Additives: 1.8% Ciba-Geigy white pigment D-1070, SP3-17 by weight (Ciba-Geigy Corporation, Hawthorne, N.Y.) 0.2% Rohm & Haas Co., Triton X-102 surfactant by weight (Rohm & Haas Co., Philadelphia, Pa.)

Testing is performed on the above and compared with the beauty coils of the prior art:

| SAMPLE | WICK/DRIP TEST perm solution absorbed (ml) |
|---|---|
| Example 1 (NR) | 21.5 |
| Wonalancet (NR) (Example 1 - core only) | 6.3 |
| Prior art products: | |
| Cellucotton (NR) | 7.7 |
| Carolina (NR) | 9.5 |
| Acme Empress (R) | 5.7 |
| Acme Empress (NR) | 11.32 |
| Acme Dutchess (NR) | 16.1 |
| Megas (R) | 9.3 |
| Witten (R) | 11.1 |
| Coillir (NR) | 9.2 |

*(R) — reinforced
(NR) — nonreinforced

A significant demonstration of the performance of the beauty coil of the present invention can be seen when comparing the inventive beauty coil of Example 1 and Wonalancet Type 460 core, which is the core of the inventive beauty coil without the cover. Wonalancet Type 460 core alone absorbs only 6.3 ml of solution before dripping. When the Wonalancet Type 460 core is enclosed in the cover of 0.375 oz/yd$^2$ spun-bond polypropylene to form the beauty coil of the present invention, however, the composite absorbs 21.5 ml of solution.

In addition, testing performed on the coil of Example 1 produces the following results:

| | |
|---|---|
| Basis Weight (g/36") | 4.5 |
| Tensile Strength, Machine Direction (g) | |
| Dry | 2121 |
| Wet | 2436 |
| Water Capacity | |
| (%) | 1835 |
| (g) | 77 |
| Water Rate (sec) | 4.0 |
| Color/Brightness (Rd) | 91 |

EXAMPLE 2

An absorbent beauty coil which prevents drippage down a user's face, is lint-free, strong, and of superior feel and appearance:

Absorbent core—nonreinforced

BASF rayon fiber: Type 8257 fiber, 100% rayon (BASF Corporation, Fibers Division, Enka, N.C.)

Covering

Scott bonded carded web Type 6714 fiber, 0.5 oz/yd$^2$ (Scott Paper Company, Philadelphia, Pa.)

Polymer:

100% polypropylene Hurcules 181 (Scott Paper Company, Philadelphia, Pa.)

Testing performed on the above produces the following test results:

| | |
|---|---|
| Basis Weight (g/36") | 5.6 |
| Tensile Strength, Machine Direction (g) | |
| Dry | 2338 |
| Wet | 2489 |
| Water Capacity | |
| (%) | 1528 |
| (g) | 85 |
| Water Rate (sec) | 1.2 |
| Color/Brightness (Rd) | 88 |

EXAMPLE 3

An absorbent beauty coil which prevents drippage down a user's face, is lint-free, strong, and of superior feel and appearance:

Absorbent core—nonreinforced

Wonalancet low basis weight non-reinforced fiber: Type 460 fiber, 100% Viscose (Wonalancet Company, Atlanta, Ga)

Covering

Scott bonded carded web Type 6714 fiber, 0.5 oz/yd$^2$ (Scott Paper Company, Philadelphia, Pa.)

Polymer:

100% polypropylene Hurcules 181 (Scott Paper Company, Philadelphia, Pa.)

Testing performed on the above produces the following test results:

| | |
|---|---|
| Basis Weight (g/36") | 4.0 |
| Tensile Strength, Machine Direction (g) | |
| Dry | 1519 |
| Wet | 2232 |
| Water Capacity | |
| (%) | 1764 |
| (g) | 69 |
| Water Rate (sec) | 1.2 |
| Color/Brightness (Rd) | 92 |

I claim:

1. A flexible absorbent beauty coil adapted to be wrapped around a user's head comprising:

(a) a flexible absorbent core and (b) a non-retentive, moisture-pervious, flexible cover comprising fibers selected from the group consisting of polyethylene, polypropylene, copolymers of ethylene and propylene, and blends of polyethylene and polypropylene, surrounding the absorbent core to form a sausage-like piece with a top end and a bottom end, which ends may be secured by any appropriate means to form a coil.

2. The absorbent beauty coil of claim 1, wherein the cover is dry, soft, low-linting material which, when located adjacent to the absorbent core, transfers liquid into the core and wicks liquid from saturated to unsaturated portions of the core, where it is absorbed.

3. The absorbent beauty coil of claim 2, wherein the absorbent core is selected from the group consisting of super-absorbent strips, cellulose wadding, nylon, cotton, rayon, polyester, or blends thereof.

4. The absorbent beauty coil of claim 1, wherein the coil has a wick/drip test absorptive capacity of greater than about 17 milliliters, a dry tensile strength of between about 300 and 4000 grams, a wet tensile strength of about 2500 grams, an absorption rate for water of not greater than about 30.0 seconds, and a water capacity of at least about 1500 percent, or at least about 75.0 grams per 36 inches of coil.

5. The absorbent beauty coil of claim 1, wherein the coil has a basis weight of between about 5.0 and 6.0 grams per 36 inches, a dry tensile strength of between about 300 and 4000 grams, a wet tensile strength of about 2500 grams, a water capacity of about 1850 percent, or at least about 75.0 grams, typically about 90.0 grams per 36 inches of coil, an absorption rate for water of not greater than 30.0 seconds, and a wick/drip test absorptive capacity of greater than about 17 milliliters.

* * * * *